US005160045A

United States Patent [19]

Falkiner et al.

[11] Patent Number: 5,160,045

[45] Date of Patent: Nov. 3, 1992

[54] PROCESS FOR REMOVING ELEMENTAL SULFUR FROM FLUIDS

[75] Inventors: Robert J. Falkiner, Mississauga; Marc A. Poirier; Ian D. Campbell, both of Sarnia, all of Canada

[73] Assignee: Exxon Research and Engineering Company, Florham Park, N.J.

[21] Appl. No.: 716,485

[22] Filed: Jun. 17, 1991

[51] Int. Cl.[5] ..... B01D 11/00

[52] U.S. Cl. ..... 210/634; 210/638; 210/721; 208/208 M; 208/230; 208/232

[58] Field of Search ..... 210/634, 721, 638; 208/230, 232, 237, 143, 207, 208 R, 208 M, 236; 423/575, 565, 567 A, 571; 55/73

[56] References Cited

U.S. PATENT DOCUMENTS

| | | | |
|---|---|---|---|
| 1,899,042 | 2/1933 | Malisoff | 208/232 |
| 2,460,227 | 1/1949 | Hart | 208/237 |
| 2,693,443 | 11/1954 | Waddell et al. | 208/237 |
| 3,000,817 | 9/1961 | De Rycke et al. | 208/232 |
| 3,166,492 | 1/1965 | Schuttze | 208/237 |
| 3,185,641 | 3/1965 | Cowden | 208/230 |
| 3,785,965 | 10/1971 | Welty | 208/230 |
| 3,791,966 | 2/1974 | Bearden, Jr. | 208/208 M |
| 4,011,882 | 3/1977 | Nivens et al. | 208/236 |
| 4,018,572 | 4/1977 | Swanson | 208/230 |
| 4,149,966 | 4/1979 | O'Donnell et al. | 208/237 |
| 4,230,184 | 10/1980 | Blytas | 208/230 |
| 4,606,812 | 8/1986 | Swanson | 208/143 |
| 4,640,832 | 2/1987 | Bittner et al. | 423/565 |
| 4,908,122 | 3/1990 | Frame et al. | 208/207 |

FOREIGN PATENT DOCUMENTS

| | | | |
|---|---|---|---|
| 904480 | 8/1962 | United Kingdom | 208/237 |

*Primary Examiner*—Robert A. Dawson
*Assistant Examiner*—Ana M. Fortuna
*Attorney, Agent, or Firm*—Roy J. Ott

[57] ABSTRACT

A process for removing elemental sulfur from fluids such as refined petroleum products transported through pipelines for the transportation of sour hydrocarbon streams. The fluids are contacted with an aqueous solution containing caustic, sulfide and optionally elemental sulfur to produce an aqueous layer containing metal polysulfides and a clear fluid layer having a reduced elemental sulfur level. Organo mercaptans may also be mixed with the fluid to accelerate the removal of elemental sulfur.

10 Claims, No Drawings

PROCESS FOR REMOVING ELEMENTAL SULFUR FROM FLUIDS

BACKGROUND OF THE INVENTION

1. Field of the Invention

This invention relates to a process for removing elemental sulfur from fluids, particularly fuels such as gasoline transported in a pipeline for the transportation of sour hydrocarbon streams. The fluids are contacted with caustic, water, sulfide and optionally elemental sulfur to form an aqueous layer containing polysulfides and a fluid layer having a reduced elemental sulfur level.

2. Description of Related Art

It is well known that elemental sulfur and other sulfur compounds contained in hydrocarbon streams is corrosive and damaging to metal equipment, particularly copper and copper alloys. Sulfur and sulfur compounds may be present in varying concentrations in the refined fuels and additional contamination may take place as a consequence of transporting the refined fuel through pipelines containing sulfur contaminants resulting from the transportation of sour hydrocarbon streams such as petroleum crudes. The sulfur has a particularly corrosive effect on equipment such as brass valves, gauges and in-tank fuel pump copper commutators.

Various techniques have been reported for removing elemental sulfur from petroleum products. For example U.S. Pat. No. 4,149,966 discloses a method for removing elemental sulfur from refined hydrocarbon fuels by adding an organo-mercaptan compound and a copper compound capable of forming a soluble complex with said mercaptan and said sulfur and contacting said fuel with an adsorbent material to remove the resulting copper complex and substantially all the elemental sulfur.

U.S. Pat. No. 4,908,122 discloses a process for sweetening a sour hydrocarbon fraction containing mercaptans by contacting the hydrocarbon fraction in the presence of an oxidizing agent with a catalytic composite, ammonium hydroxide and a quaternary ammonium salt other than hydroxide.

U.S. Pat. No. 3,185,641 describes a method for removing elemental sulfur from a liquid hydrocarbon which comprises contacting with solid sodium hydroxide a hydrocarbon stream having dissolved therein at least 7.6 parts by weight of water per part of sulfur contained therein to yield both a hydrocarbon phase and an aqueous phase. The method is claimed to be effective and convenient for treating gasoline containing from trace to more than 25 ppm sulfur employing temperatures as high as about 140° F. (60° C.).

U.S. Pat. No. 4,011,882 discloses a method for reducing sulfur contamination of refined hydrocarbon fluids transported in a pipeline for the transportation of sweet and sour hydrocarbon fluids by washing the pipeline with a wash solution containing a mixture of light and heavy amines, a corrosion inhibitor, a surfactant and an alkanol containing from 1 to 6 carbon atoms.

SUMMARY OF THE INVENTION

The present invention provides a process for removing elemental sulfur from fluids such as hydrocarbon fuels, fuel blending components such as octane improvers, liquified petroleum gas (LPG), solvents and other petroleum streams transported in a pipeline for the transportation of sour hydrocarbon streams, comprising contacting the sulfur-containing fluid with an inorganic caustic material, water, sulfide, and optionally elemental sulfur to form an aqueous layer containing polysulfides and a fluid layer having a reduced elemental sulfur level. The fluid layer is decanted from the aqueous layer leaving a treated product having a low residual elemental sulfur content. The fluid may additionally be contacted with an organo mercaptan to accelerate removal of elemental sulfur.

DETAILED DESCRIPTION OF THE INVENTION

The inorganic caustic material which is employed in this invention includes alkali metal or ammonium hydroxides having the formula MOH wherein M is selected from the group consisting of lithium, sodium, potassium, $NH_4$ or mixtures thereof. M is preferably sodium or potassium.

The sulfide which is employed in this invention includes sulfides of metals from Groups I and II of the Periodic Table. Examples of sulfides include $Na_2S$, $K_2S$, $Li_2S$, NaHS, $(NH_4)_2S$, $H_2S$ (the fluid itself could provide the source of $H_2S$) and the like. $Na_2S$ is preferred.

Elemental sulfur may also be added with the caustic and sulfide. The sulfide in caustic reacts with the elemental sulfur in the fluid to be treated to form polysulfides in caustic. Elemental sulfur may be added for promoting the reaction or if it is present in a convenient source of caustic such as white liquor from paper pulp mills.

Organo mercaptans may also be employed in the process of the invention. The organo mercaptan forms a soluble sulfur complex with the elemental sulfur, thereby accelerating its removal. The organo mercaptans which may be used include a wide variety of compounds having the general formula RSH, where R represents an organic radical which may be alkyl, alkenyl, cycloalkyl, cycloalkenyl, aryl of arylalkyl having from 1 to about 16 carbon atoms. Thus, the radical may be, for example methyl, ethyl, n-propyl, i-propyl, n-butyl, i-butyl, sec-butyl, t-butyl, amyl, n-octyl, decyl, dodecyl, octadecyl, phenyl, benzyl and the like. Most preferably, RSH is an alkyl mercaptan containing 2 to 5 carbon atoms.

Alcohols such as methanol, ethanol, propanol, ethylene glycol, propylene glycol and the like may also be added to the mixture which is contacted with the fluid to be treated. The amount of alcohol used may vary within wide limits. In the case of methanol, for example, from 0 to about 90 volume percent of the water may be replaced with alcohol.

The fluids which are treated in accordance with the invention include fluids containing elemental sulfur where the elemental sulfur is detrimental to the performance of the fluid. The invention is particularly applicable to those liquid products which have become contaminated with elemental sulfur as a result of being transported in a pipeline previously used to transport sour hydrocarbon streams such as petroleum crudes.

The fluids treated in accordance with the invention include a wide variety of petroleum fuels and particularly refined hydrocarbon fuels such as gasoline, jet fuel, diesel fuel and kerosene.

Other fluids include ethers used to improve the octane ratings of gasoline. These ethers are typically dialkyl ethers having 1 to 7 carbon atoms in each alkyl group. Illustrative ethers are methyl tertiary-butyl ether, methyl tertiary-amyl ether, methyl tertiary-hexyl ether, ethyl tertiary-butyl ether, n-propyl tertiary-butyl ether, isopropyl tertiary-amyl ether. Mixtures of these ethers and hydrocarbons may be treated in accordance with the invention.

Fluids containing quantities of elemental sulfur as high as 100 mg, or higher, sulfur per liter, more usually from about 10 to about 60 mg per liter, can be effectively treated in accordance with this invention to reduce the sulfur contamination to about 5 mg sulfur per liter or lower.

In general, the process of the invention involves the addition to the fluid to be treated of effective amounts of caustic, water, sulfide, and optionally organo mercaptan, elemental sulfur and/or alcohol. The mixture is allowed to settle so as to form an aqueous layer containing metal polysulfides and a clear fluid layer having a reduced elemental sulfur level. Contact with the mercaptan would result in a clear fluid layer having a reduced elemental sulfur level and containing soluble polysulfide reaction products which are relatively noncorrosive. The treated fluid may be recovered by decantation. The recovered aqueous layer may be recycled back to the mixing zone for contact with the fluid to be treated or it may be discarded or used, for example, as a feedstock to sulfite pulping paper mills.

The treating conditions which may be used to carry out the present invention are conventional. Contacting of the fluid to be treated is effected at ambient temperature conditions, although higher temperatures up to 100° C. or higher may be employed. Substantially atmospheric pressures are suitable, although pressures may, for example, range up to 1,000 psig. Contact times may vary widely depending on the fluid to be treated, the amount of elemental sulfur therein and the treating materials used. The contact time will be chosen to effect the desired degree of elemental sulfur conversion. The reaction proceeds relatively fast, usually within several minutes, depending on solution strengths and compositions. Contact times from 30 seconds to a few hours may be employed.

The reactants may be dispersed within the fluid to be treated using any suitable mixing device which will provide adequate mixing with the fluid. Thereafter the mixture is allowed to settle to produce the aqueous and fluid layers.

While the reactants employed in the invention may be contacted with the fluid to be treated in accordance with known techniques, it is convenient to prepare an aqueous mixture of caustic metal sulfide and elemental sulfur. The mixture is then contacted with the fluid to be treated. The organo mercaptan may also be employed, usually as a separate stream which may be mixed with the fluid to be treated.

The proportion of water, caustic, sulfide and elemental sulfur to be mixed may vary within wide limits. Typically, the aqueous treating solution contains caustic in the range of 0.01 to 20M, the sulfide concentration is from 0.1 to 20M and the elemental sulfur concentration is from 0 to 10% by weight. The amount of organo mercaptan which may be optionally added may range from 0 to about 2 moles of organo mercaptan per mole of elemental sulfur present in the fluid to be treated. The relative amount of aqueous treating solution containing caustic, metal sulfide and optionally elemental sulfur and the fluid to be treated may also vary within wide limits. Usually about 0.05 to 10, more usually, 0.25 to 0.5 volumes of aqueous treating solution will be used per volume of fluid to be treated.

The following examples are illustrative of the invention.

EXAMPLE 1

In this Example the following solutions were prepared.

Solution A: 20 g sodium hydroxide+24 g sodium sulfide ($9H_2O$)+0.53 g elemental sulfur in 100 ml water (5M NaOH, 10M $Na_2S$, 0.53 wt % S)

Solution B: 20 g sodium hydroxide+24 g sodium sulfide ($9H_2O$) in 100 ml water (5M NaOH, 10M $Na_2S$).

Solution C: 20 g sodium hydroxide in 100 ml water (5M NaOH)

Solution D: 50 ml saturated sodium hydroxide in water+12 g of sodium sulfide ($9H_2O$).

EXAMPLE 2

Into a beaker were added 100 ml of pipelined gasoline having an elemental sulfur level of 30 mg/L elemental sulfur (Mercury Number Method; UOP Method 286-59). The gasoline was stirred for 1 hour with 50 ml of Solution A, allowed to settle and thereafter decanted to produce a treated gasoline having an elemental sulfur level of 7 mg/L.

EXAMPLE 3

Into a beaker were added 100 ml of pipelined gasoline having an elemental sulfur level of 44 mg/L elemental sulfur. The gasoline was stirred for 1 hour with 25 ml of Solution A and 25 ml of Solution B, allowed to settle and thereafter decanted to produce a treated gasoline having an elemental sulfur level of 4 mg/L. The treated gasoline was treated again as above in this example to produce a gasoline having an elemental sulfur level of 3 mg/L.

EXAMPLE 4

100 ml of the pipelined gasoline of Example 3, 25 ml of Solution A and 25 ml of Solution C were mixed for 1 hour. The mixture was then allowed to settle and the gasoline removed by decantation. The treated gasoline had an elemental sulfur level of 3 mg/L, showing that dilution with caustic still achieved significant sulfur removal.

EXAMPLE 5

100 ml of the gasoline of Example 3 and 50 ml of Solution C were mixed for 1 hour. The mixture was then allowed to settle and the treated gasoline removed by decantation. The treated gasoline has an elemental sulfur level of 41 mg/L, showing that caustic alone does not remove significant amounts of elemental sulfur.

EXAMPLE 6

100 ml of the gasoline of Example 3 and 50 ml of aqueous solution containing 12 g of sodium sulfide ($9H_2O$) (10M) were mixed for 1 hour. The mixture was then allowed to settle and then the treated gasoline removed by decantation. The treated gasoline had an elemental sulfur level of 30 mg/L, showing that sulfide alone is not very effective for removing elemental sulfur.

EXAMPLE 7

100 ml of the gasoline of Example 3 and 50 ml of solution D were mixed for 24 hours. The mixture was then allowed to settle and then the treated gasoline removed by decantation. The treated gasoline had an elemental sulphur of 3 mg/L, showing that addition of elemental sulphur in the aqueous phase is not essential to remove the elemental sulphur from the gasoline.

What is claimed is:

1. A process for reducing the elemental sulfur content of a fluid containing same, comprising mixing said fluid without the addition of an aromatic mercaptan with water, inorganic caustic and a sulfide in amounts effective to form after completion of mixing an aqueous layer containing polysulfides and a fluid layer having a reduced elemental sulfur level and recovering the treated fluid.

2. The process of claim 1 wherein said inorganic caustic is NaOH.

3. The process of claim 2 wherein said sulfide is $Na_2S$.

4. The process of claim 3 wherein the fluid is a refined petroleum fuel which has been transported through a pipeline used to transport a sour hydrocarbon stream.

5. The process of claim 1 wherein the fluid is mixed with elemental sulfur.

6. A process for reducing the corrosivity of a hydrocarbon fuel by removing elemental sulfur resulting from the transportation of said fuel through a pipeline used to transport a sour hydrocarbon stream, which process comprises mixing said fuel without the addition of an aromatic mercaptan with water caustic and a sulfide in amounts effective to form after completion of mixing an aqueous layer containing metal polysulfides and a fuel layer having a reduced elemental sulfur level and recovering the treated fuel.

7. The process of claim 6 wherein said fuel is contacted with an aqueous NaOH solution containing $Na_2S$.

8. The process of claim 6 wherein the fuel is mixed with elemental sulfur.

9. The process of claim 7 wherein the fuel is mixed with an alcohol.

10. The process of claim 6 comprising recovering a treated fuel having an elemental sulfur level of 5 mg/L or lower.

* * * * *